US007312386B2

(12) United States Patent
Sielaff et al.

(10) Patent No.: US 7,312,386 B2
(45) Date of Patent: Dec. 25, 2007

(54) PICK ATTACHMENT DEVICE

(75) Inventors: Drayth S. Sielaff, Weiser, ID (US); Rollie W. Sielaff, Meridian, ID (US)

(73) Assignee: Grip Guitar Picks, Inc., Meridian, ID (US)

( * ) Notice: Subject to any disclaimer, the term of this patent is extended or adjusted under 35 U.S.C. 154(b) by 149 days.

(21) Appl. No.: 10/904,065

(22) Filed: Oct. 21, 2004

(65) Prior Publication Data

US 2006/0086231 A1 Apr. 27, 2006

(51) Int. Cl.
*G10D 3/16* (2006.01)

(52) U.S. Cl. ..... 84/320

(58) Field of Classification Search ..... 84/320, 84/321, 322

See application file for complete search history.

(56) References Cited

U.S. PATENT DOCUMENTS

| | | | | |
|---|---|---|---|---|
| 756,348 A | | 4/1904 | Forney | 84/322 |
| 3,992,975 A | * | 11/1976 | Gallagher | 84/322 |
| 4,015,502 A | | 4/1977 | Strong | 84/322 |
| 4,102,234 A | * | 7/1978 | Brundage | 84/322 |
| 4,497,237 A | | 2/1985 | Beall | 84/322 |
| 4,625,616 A | | 12/1986 | McVicker | 84/322 |
| 4,741,239 A | * | 5/1988 | Crafton | 84/322 |
| 5,864,075 A | | 1/1999 | Mapson | 84/322 |
| 6,335,477 B1 | | 1/2002 | Miller | 84/322 |
| 6,417,431 B1 | * | 7/2002 | Wilkinson | 84/322 |
| 6,737,569 B2 | | 5/2004 | Kees | 84/322 |
| 6,797,871 B2 | | 9/2004 | Atkin | 84/322 |
| 6,815,597 B1 | * | 11/2004 | Bosley | 84/322 |

* cited by examiner

*Primary Examiner*—Kimberly Lockett
(74) *Attorney, Agent, or Firm*—Your Intellectual Property Matters, LLC; Robert A. Frohwerk

(57) ABSTRACT

A resilient band holds a pick for a stringed musical instrument securely in contact with a thumb or finger of the instrumentalist. In one aspect this device appears as a ring that has been slit along its center line over a portion of its circumference, the slit then being separated to produce a Y-shape. The two arms and leg of the Y provide the pick with a three-point support that maintains stability of the pick against a finger in both strumming and plucking modes over a wide range of attack angles. The resiliency of the band serves to adapt to various fingers as well as to a variety of conventional picks according to the preferences of the user, including flat picks, thumb picks, and finger picks. Methods of manufacture are described.

19 Claims, 5 Drawing Sheets

PICK ATTACHMENT DEVICE

FIELD OF THE INVENTION

The present invention relates in general to an accessory that is used by a person to excite the strings of a stringed instrument. Specifically, the invention relates to a means of comfortably securing a handheld pick to a finger of the user.

BACKGROUND OF THE INVENTION

Among players of stringed instruments who use a pick rather than a finger or fingernail, most prefer to use some form of conventional pick. Such picks, or plectrums, are generally made from small thin pieces of plastic or similar material having a rounded triangular shape. A user of a pick most often holds it between a thumb and the opposing index finger. The more pointed end of the pick extends beyond the finger and thumb to contact and excite the strings in either a plucking or strumming manner. If the user is not careful to maintain a relatively constant force to grip the pick between the thumb and finger, the pick may rotate away from proper playing position or be dropped completely. The force required by the user can be fatiguing over long periods of play. In U.S. Pat. No. 6,346,662 Sielaff has shown an ergonomically shaped pick that generally conforms to the shape of the thumb and index finger that grasp it. This was one attempt to reduce the required force and delay the onset of fatigue during a play session.

One primitive solution that has been used to reduce the stress between the thumb and index finger is to fasten the pick to the thumb with a common rubber band. While this may be acceptable in some cases, more often than not at least one of two problems arise: either the pick twists or rotates with respect to the thumb because the rubber band is too loose; or circulation of blood to the finger tip is reduced resulting in a loss of sensitivity, if not pain, from a rubber band that is too tight.

A different approach has been to incorporate some form of a specially designed pick mechanism into a structure that is fitted to a thumb or other finger. Such devices generally take the form of a thimble or a ring. One of the earlier examples of this format was Formey's 1904 U.S. Pat. No. 756,348 for an annular band with an integrated, substantially semicircular, loop having an abrupt projection, which extended beyond the finger tip, for picking. Some devices of this type offer great stability to the pick mechanism by requiring that they be sized to fit a particular thumb or finger of each individual user. One shortcoming that arises once such a device has been fitted is that it often becomes uncomfortably warm due to heat accumulated over a prolonged session of play.

Picking devices that are either conformable or adjustable to an individual's finger have been shown in a variety of formats. Strong provided in his U.S. Pat. No. 4,015,502 an adjustable strap connected to a wire frame that doubled as a pick. A device which allowed a pick element to slide along a finger-engaging wire band was described by Beall in U.S. Pat. No. 4,497,237. McVicker was granted U.S. Pat. No. 4,625,615 for a Thumb Pick made from a single flat piece of flexible material having two parallel slits forming three straps which engaged a thumb. A fingernail shaped pick body having an annular band at its rear and a criss-crossing strip nearer its tip was secured to a finger in the device that was patented by Crafton in U.S. Pat. No. 4,741,239. Miller showed in U.S. Pat. No. 6,335,477 how to form a specially shaped resilient band to serve as a pick that could be wrapped around any finger or thumb.

The object of all of these devices has been to provide a means of fastening a specially designed pick to a thumb or finger. In many cases the pick has been an integral part of the fastening mechanism itself. U.S. Pat. No. 5,864,075 granted to Mapson showed both finger and thumb picks, each being formed as a single unit with wings that wrapped around the finger or thumb. However, Mapson extended his design to describe a form that provided a swivel fastener that could accept a special compatible pick. Recently, Atkin has shown in U.S. Pat. No. 6,797,871 a thumb sleeve that will accept, either interiorly or exteriorly, an attachable and releasable pick by means of a hook and loop fastener. Again, these devices all require a pick that has been fitted with some sort of special adapter.

The Pick Harness described by Brundage in U.S. Pat. No. 4,102,234 departs from other designs by providing a means of securely holding a conventional pick. Brundage shows a flexible strap that encircles the thumb and has three triangularly-related slits that accept the apices of the conventional pick with provision for the pointed end of the pick to protrude through one of the slits into a playing position.

BRIEF SUMMARY OF THE INVENTION

Many complex devices have been designed to incorporate some form of a specially designed pick, or pick mechanism, into a special attachment device for holding the pick structure closely to a thumb of a person playing a stringed musical instrument. Few devices have provided support for a conventional pick of the user's choosing. It is an object of the present invention to provide a simple means of securely attaching a conventional pick chosen by the user so that it remains in close contact with the user's thumb or other playing finger. The described invention is intended to be comfortable over large variations in sizes and shapes of both picks and fingers. While the present invention is intended to be usable with any pick, be it a flat-pick or a thumb pick, it is especially well adapted for use with a pick that conforms to the user's finger, such as the Grip™ Pick, a product of Grip Guitar Picks, Inc., described by Sielaff in U.S. Pat. No. 6,346,662. This pick attachment device has an advantage over some previous solutions in that it is stronger, holding the pick more securely to the finger, without causing the user a sensation of it being tight. Furthermore, it will be inexpensive to manufacture.

The basic structure of the device produced under the present invention is that of a resilient band that has been slit longitudinally along a portion of its circumference. As the band is separated at the slit, one side from the other, it forms in one perspective a three-pronged Y-shape having what may be described as two narrow arms resulting from the slit and a wider leg remaining at the unslit portion. A conventional pick of the user's choosing can be slipped sideways into the flattened band. The more pointed lobe or apex of the pick will be inserted into the band so that the two arms of the Y can be separated so as to fall one on either side of the apex while the leg of the Y supports the opposite straighter edge of the pick. With the pick thus encompassed a user will then insert a playing finger between the resilient band and the pick. In this manner a conventional pick will be held in place against a user's playing finger by the presently described invention.

There are many possible variations of the basic structure, which although seemingly minor will have important effects on the resulting device. These alternatives will be understood best in light of the included Drawings in conjunction with the Detailed Description that follows.

DETAILED DESCRIPTION OF THE INVENTION

In normal play a conventional thumb pick will be held between the thumb and an opposing finger, usually an index finger. That is, the pick is supported by force applied to its two faces. To relieve the user from the need to pinch a thumb pick in this manner, it is necessary to replace the force applied by the opposing finger that holds the pick in contact with the thumb. Instead of being pushed into the thumb, the pick must be pulled into it. In the present invention the replacement force is supplied by a band made from a flexible resilient material. As the band is stretched around the back side of a thumb or finger, a tension is developed that ideally is comparable to the force that would have been applied by an opposing finger.

When the presently described invention is used to hold a pick firmly in the proper position for playing, an opposing finger that would have been required to maintain contact with the pick is freed up. This allows an instrumentalist to use other styles of play involving the newly freed finger, which may itself take on an additional pick using another instance of the invention.

Since conventional picks, whether flat picks or thumb picks, are generally triangular with rounded apices, it is convenient to support them at three points, one on each edge. Indeed, it is well known in the mechanical arts that a three-point support provides the greatest possible stability. This is not to be taken as a limitation to embodiments of the present invention, since a three-point support system is readily adaptable to almost any shape of pick, whether it be nearly round or very pointed.

Figure 1:
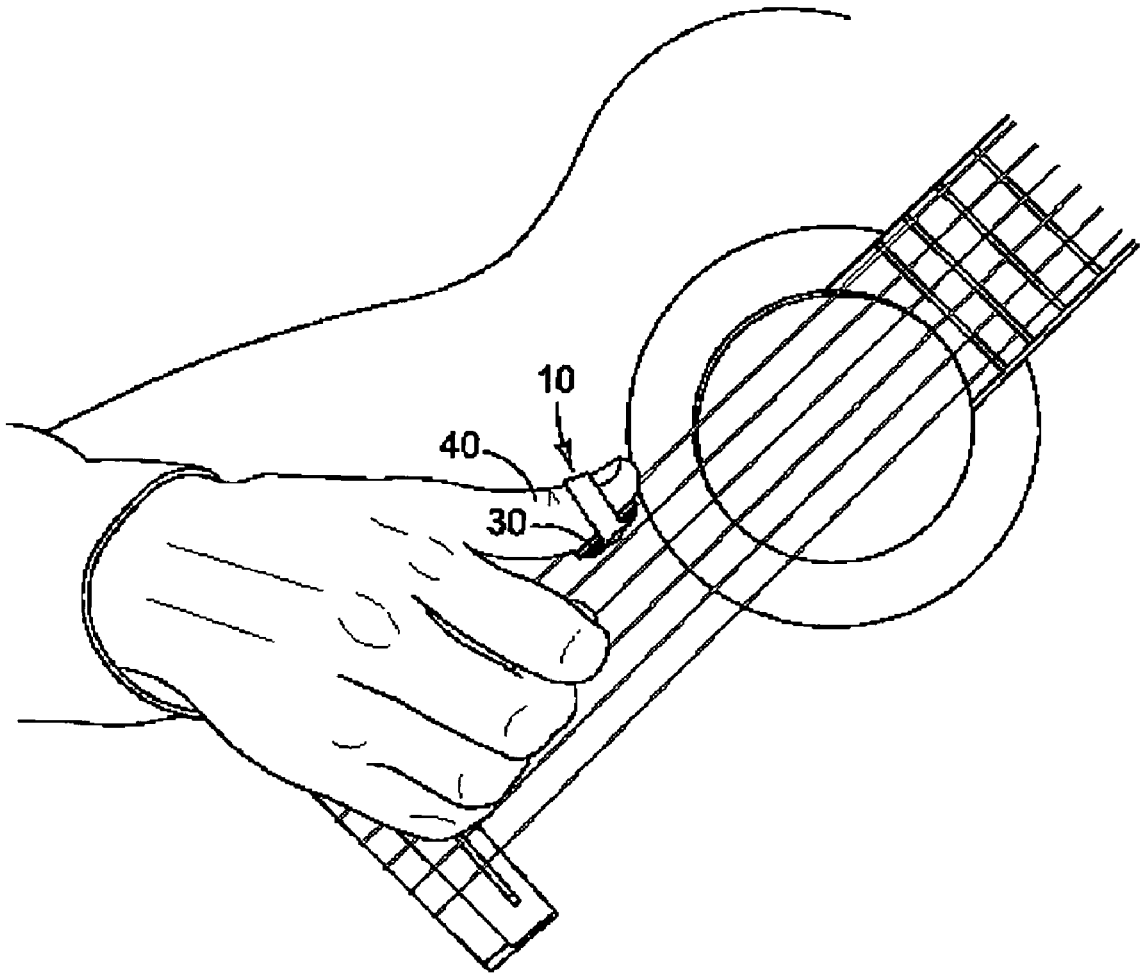
FIG. 1 is a front view of a person playing a stringed musical instrument while using one embodiment of the invention to attach a pick to a thumb.
Figure 2:
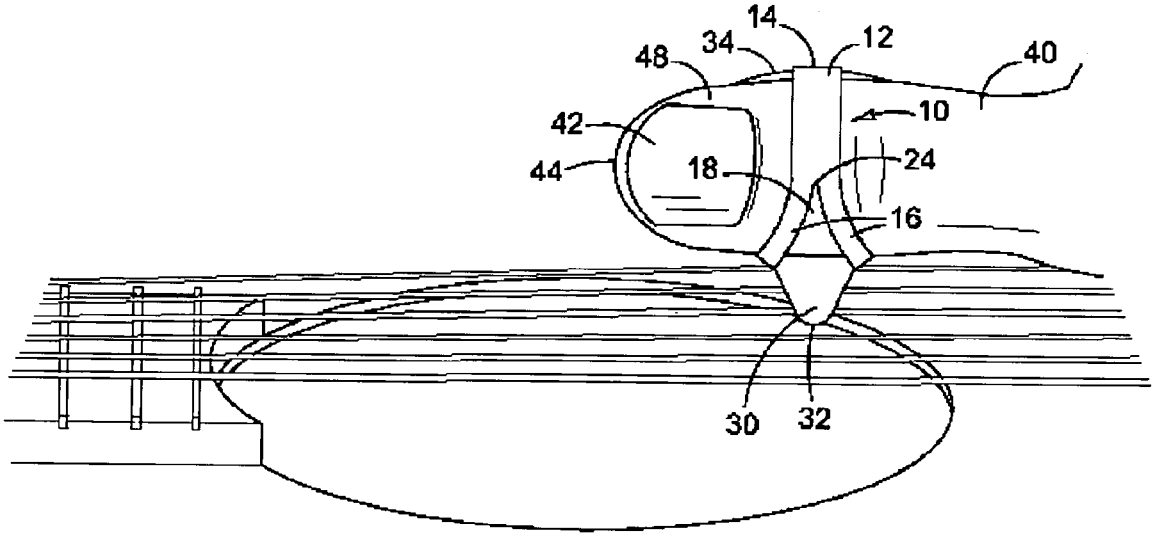
FIG. 2 shows the top view of an embodiment of the invention in use for attachment of a pick to a thumb as a user would see it when playing a guitar.
Figure 3:
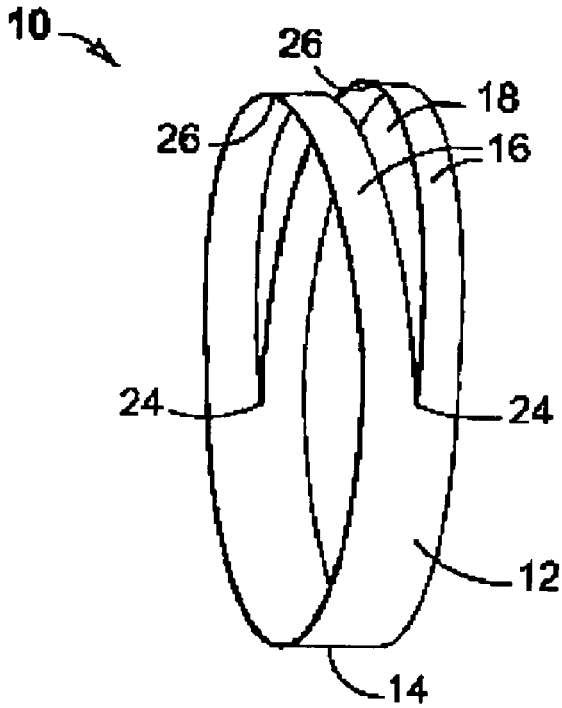
FIG. 3 depicts an embodiment of the present invention when it is not in use.

The present invention is shown in use attached to a thumb of an instrumentalist in FIG. 1, where a conventional pick 30 is held securely in place against a user's finger 40 by an instance of the invented pick attachment device 10. The features of such a pick attachment device 10 may be seen in FIG. 2 in a typical use, and in an unused standalone situation in FIG. 3. A longitudinal slit 18 has been cut through a portion of the circumference of the band 12. It will be recognized that in one perspective spreading open the arms 16 about the slit 18 results in an apparent Y-shaped device with the leg of the Y being at the back side or base 14 of the pick attachment device 10. This creates an aperture allowing the arms 16 of the band 12 to be separated so as to provide two pick-engaging surfaces 26 (more readily visible in FIG. 5) at the interior of the ends of the arms 16.

Figure 4:
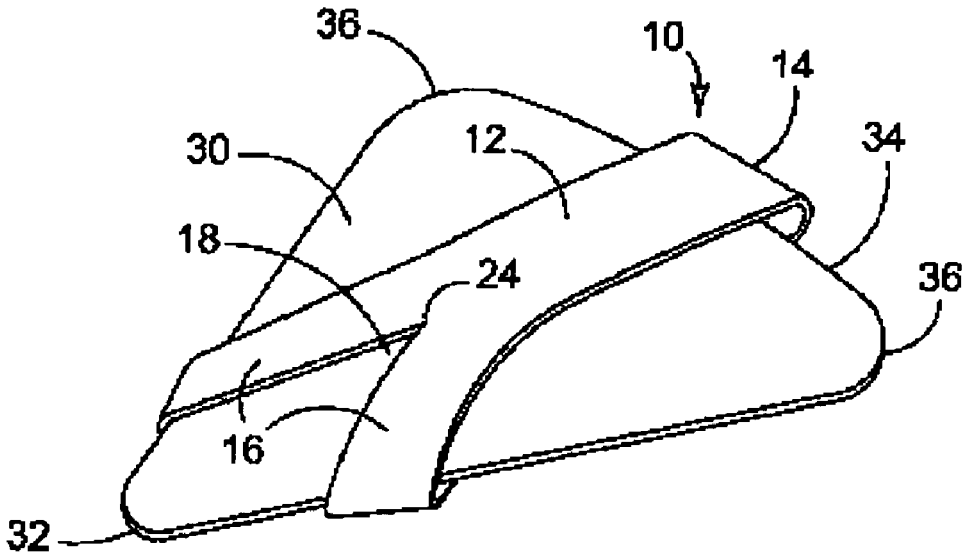
FIG. 4 shows a perspective view of a pick attachment device of the present invention engaging a pick when the combination is not in use.

Turning to FIG. 4 it will be seen how a conventional pick 30 can be installed to be held by the pick attachment device 10. First, the playing portion or front apex 32 of the pick 30 will be inserted into the band 12 so as to protrude between the ends of the arms 16. Then the pick 30 will be twisted within the band 12 so that a rear apex 36 passes the base 14 of the pick attachment device 10 with the pick's rear 34 finding final support inside the base 14.

Figure 5:
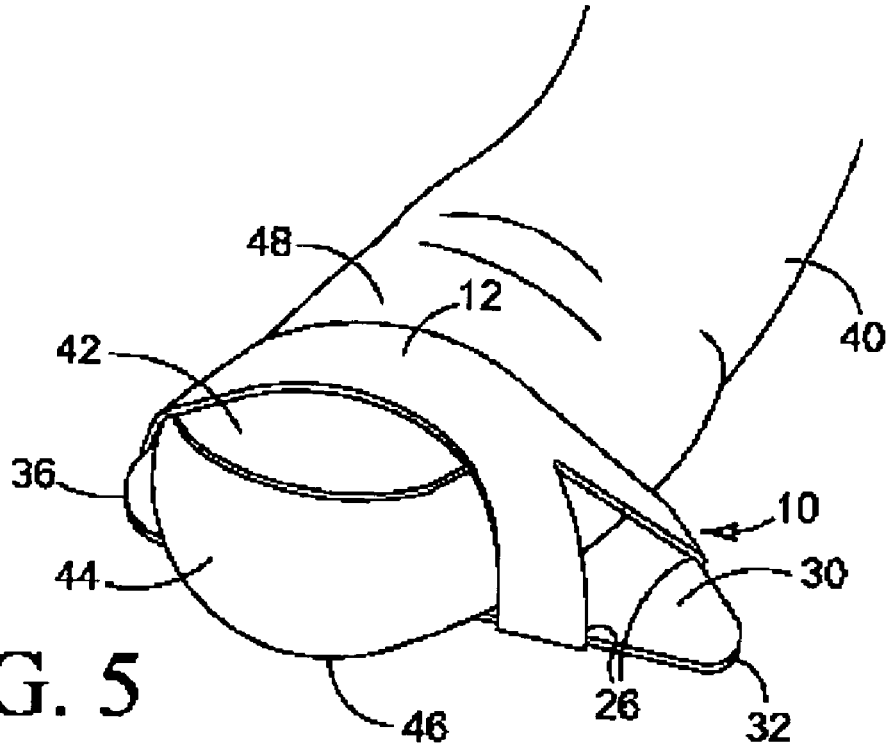
FIG. 5 is a perspective view of a pick attachment device supporting a pick in a playing position on a user's finger.
Figure 6:
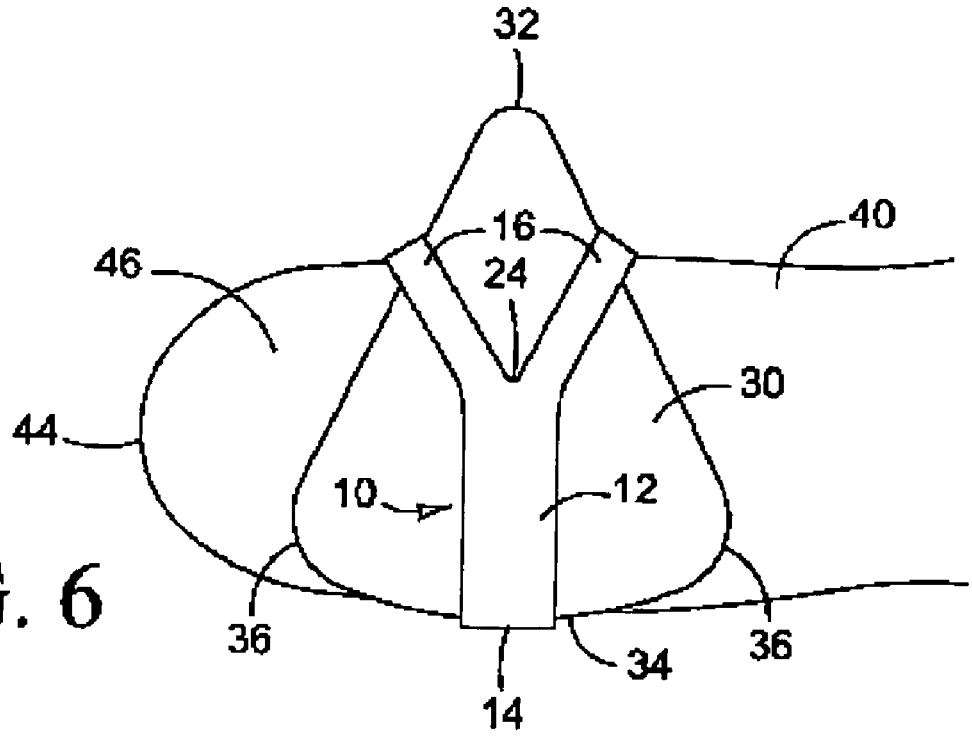
FIG. 6 shows a bottom view of the fleshy underside of a user's finger with a conventional pick attached by means of a pick attachment device of the present invention.

To use this combination of pick 30 and attachment device 10, refer to FIG. 5 which shows the result of the combination after it has been installed on a user's finger 40. A user simply slips the tip 44 of a playing finger 40 between the pick 30 and its attachment device 10 with the fleshy part 46 of the finger 40 against the pick 30 so that the attachment device 10 comes to rest against the fingernail 42 or back side 48 of a playing finger 40. The resilience and flexibility of the attachment device material allows it to conform to a variety of combinations of picks and fingers while holding the pick 30 comfortably against the playing finger 40 as shown in the bottom view of FIG. 6.

Figure 7:
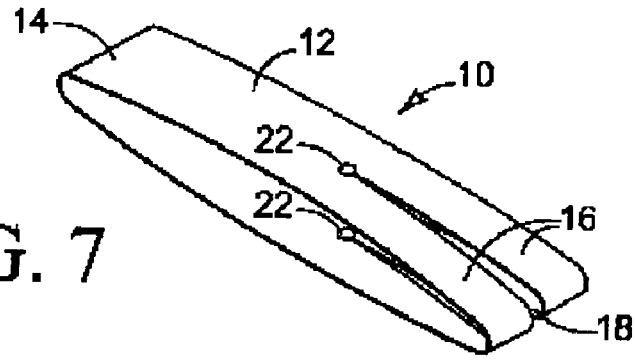
FIG. 7 depicts a single instance of the present invention in a flattened condition.

Most combinations of fingers and picks will be accommodated by beginning with a plastic or rubber tube having an inner diameter of about ¾". When flattened, as illustrated in FIG. 7, such a tube will have a length of approximately 1⅛". The preferred embodiment of a pick attachment device 10 in the present invention will be made from a ⅛" wide segment of such a tube by cutting a slit 18 having a total length of ⅝" through the centerline of the segment along a circumference of the band. The easiest way to form this slit 18 is to cut 5/16" inward from the edge of the flattened tube along its centerline. After preparing the slit 18, with the segment of tubing still flat, the ends of the arms 16 of the resulting Y will be separable to form an angle approaching 90° at the fork 24 between them, as was seen in the various views of FIG. 2 and FIGS. 4-6. A longer slit 18 that extends up to one-half of the circumference of the band will produce a more open Y with an angle at the fork 24 approaching 120°. Wide angles may be useful for better control of a more rounded pick 30, but wider than about 120° may allow the pick to become loose during play as the arms 16 separate and the pick works its way through the slit 18. An alternate embodiment of the present invention may be made from a tapered or other non-rectangular shaped segment of a flattened tube. This might be useful to accommodate greater width at the end of the arms 16 without unnecessarily increasing the width of the band 10 in contact with the finger 40.

While there might be some temptation to use a wider band, as has been the case in the prior art, and to cut a slit horizontally across the band rather than around it, this should be avoided. A wider band tends to cause discomfort due to accumulated heat, though it is recognized that this may be partially overcome by perforations in the band depending upon the material being used. Additionally, turning a pick so that its edges engage the forks at the ends of a slit tend to place undue stress at those forks and may cause them to tear out. To avoid potential tear out, or runs, at the ends of the slit, it may be helpful to superimpose a small diameter hole 22 at the two forked ends 24 of the slit 18 to relieve stress.

The preferred mode of use wherein the playing tip 32 of the pick 30 protrudes between the arms 16 of the Y is most amenable to standard thumb picking. This is not to preclude other playing styles. Although this description has covered the more common case in which the pick 30 is worn attached to the fleshy surface 46 of the thumb or finger and the band 10 is stretched across the nail on the back of the digit, there is no limitation that would prevent accommodation to styles of play where the pick attachment device 10 is rotated to position the pick 30 at the back side of the digit to be adjacent to the fingernail 42. Furthermore, the pick 30 may be rotated so that one of its rear apices 36 is held by the pick-engaging arms 16 allowing the playing tip 32 to extend beyond the end of a finger 44, though successful use of this mode is somewhat dependent upon the shape of the pick 30.

Production of Pick Attachment Device

Figure 8:
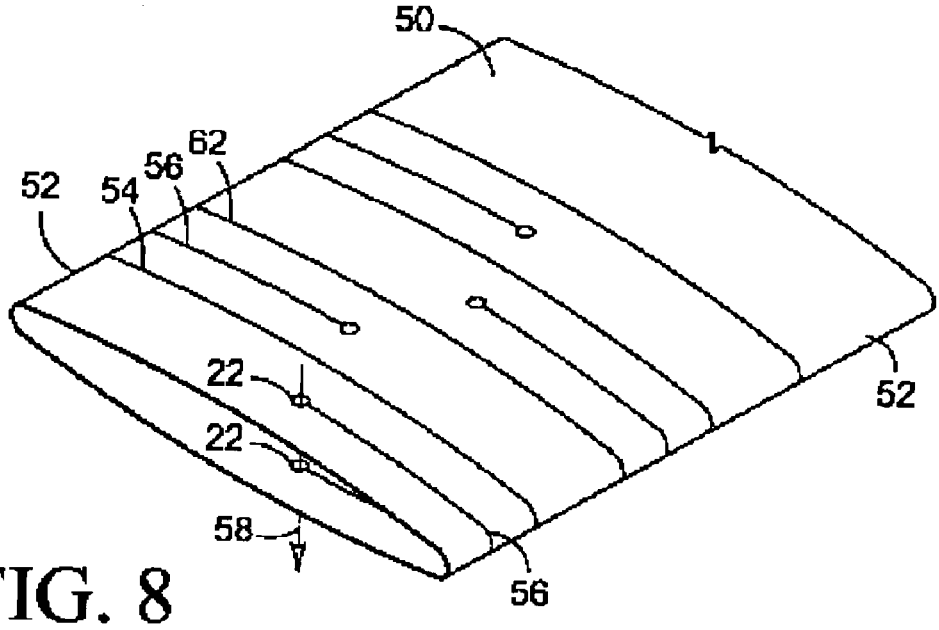
FIG. 8 illustrates one method of producing multiple instances of the pick attachment device from a segment of flexible resilient tubing that has been flattened.

The pick attachment device 10 will generally be produced from a rubber or rubber-like material. Although a single item can be cut from an individual rubber band of the right size, this is inefficient and prone to error. Mass production can be relatively straightforward as will now be described in reference to FIG. 8. A tube 50 of the appropriate material having a proper diameter and thickness is flattened, generally by a press or roller. Some caution is necessary at this step to avoid irreversibly creasing the edges 52 of the flattened tube. While a slight creasing may be advantageous to better hold the pick in the proper position, especially when using a material that lacks conformability due to low pliability or a slick surface, care must be taken that the material is not adversely weakened.

Figure 9:
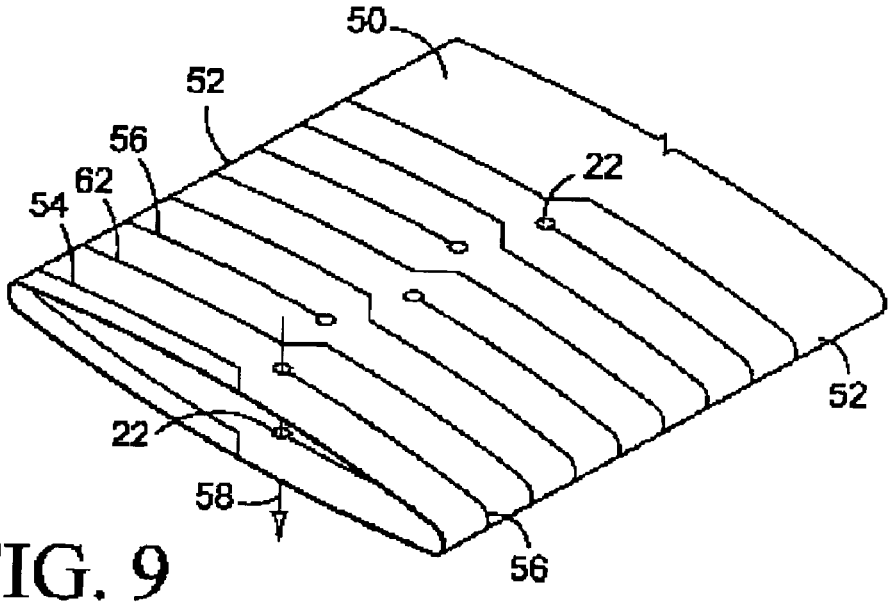
FIG. 9 shows a method of production of multiple instances of the pick attachment device in an alternate format.

A first cut 54 may sever waste or previous product from the end of the tube 50 in preparation for continued production. This first severing cut 54 may be square with respect to the flattened edge 52 or tapered or shaped as shown in one alternate embodiment in FIG. 9. A slitting cut 56 is then made from one of the flattened edges 52 toward the center of the width of the tube. There is a tendency in some plastic, rubber-like materials for a cut to tear out or creep. As a preventive measure one alternate embodiment provides for a small diameter hole 58 to be punched at the end of the slit 56 to act as a strain relief. The final step in this process is to make a second severing cut 62 to separate one finished instance of a pick attachment device 10 from the remainder of the tubing material 50.

It will be apparent to those skilled in such manufacturing arts that this process may be carried out in batch mode using a specially made punch of finite size to produce multiple items from a predetermined length of tubing. It will also be recognized that this process is amenable to a continuous production mode wherein the tubing 50 is fed through a roller system containing appropriately spaced cutting and punching dies. Depending upon the material being used it may be desirable to anneal or temper the exposed surfaces of at least some of the cuts. Those familiar with such processes will recognize that this may be accomplished simultaneous with the cutting operations. For some materials the hole 58 that acts as a strain relief at the end of the slit 56 may preferably be drilled rather than punched.

While the present invention has been described with respect to a preferred embodiment, and alternate embodiments and methods of manufacture have been shown, there is no implication to restrict the present invention to preclude other implementations that will be apparent to those skilled in the related arts. It is easily recognized that the described invention may be produced in various sizes and is scalable to accommodate wide variations in picks and fingers. It may be constructed from a variety of materials. Therefore, it is not intended that the invention be limited to the disclosed embodiments or the specifically described details, insofar as variations can be made within the spirit and scope of the appended claims.

What is claimed is:

1. An attachment device for use in combination with a pick for a stringed musical instrument, the attachment device serving to hold the pick in contact with a finger of a user during play of said stringed musical instrument, the attachment device comprising a finger-engaging band, the finger-engaging band further comprising:

a flexible resilient material; and a single longitudinal slit through a portion of the finger-engaging band centrally located within the width of the finger-engaging band.

2. The attachment device of claim 1 wherein an apex of the pick projects through and transverse to said longitudinal slit, the projection of the apex of the pick being tangentially away from the finger of the user and of sufficient distance for the apex to engage the strings of said stringed musical instrument.

3. The attachment device of claim 1 wherein the pick is a conventional guitar pick.

4. The attachment device of claim 1 wherein the pick is attached in a normal playing position to the finger of the user.

5. The attachment device of claim 1 wherein the finger is a thumb.

6. The attachment device of claim 1 wherein said flexible resilient material is plastic, rubber or rubber-like.

7. The attachment device of claim 1 wherein said flexible resilient material is nylon.

8. The attachment device of claim 1 wherein said longitudinal slit extends no further than one-half of the circumferential length of the finger-engaging band.

9. The attachment device of claim 1 wherein said longitudinal slit extends at least one-fifth of the circumferential length of the finger-engaging band.

10. The attachment device of claim 1 wherein the pick has a first surface, a second surface and a shallow perimeter between said first surface and said second surface, and wherein the attachment device supports the pick at three regions of the perimeter.

11. The attachment device of claim 10 wherein an apex of the pick projects tangentially away from the finger of the user between two of the three regions of support and transverse to said longitudinal slit.

12. The attachment device of claim 1 wherein the pick has a first surface, a second surface, and a shallow perimeter between said first surface and said second surface, the perimeter comprising a tip and an opposing edge, and wherein the pick is encompassed by the finger-engaging band such that a portion of said first surface is in contact with a length of the interior of the finger-engaging band, and the interior of the finger-engaging band makes contact with said opposing edge of the perimeter of the pick in a region of the finger-engaging band near that which is most distant from the center of said longitudinal slit, and said tip protrudes beyond the finger-engaging band through an opening formed by said longitudinal slit and transverse to said longitudinal slit, and the interior of the finger-engaging band makes contact with the perimeter of the pick at two additional regions which are separated by the tip, the two additional regions making contact with the interior of the finger-engaging band near the lengthwise center of said longitudinal slit, and wherein said second surface of the pick is held in contact with the finger of the user.

13. A method of production for one or more instances of an attachment device, each instance of said attachment device being useful as a means of attachment of a conventional stringed musical instrument pick to a finger of an instrumentalist, said method of production, comprising the steps of:

acquiring tubing of appropriately resilient material having certain desirable characteristics of diameter and wall thickness;

flattening the tubing acquired in the acquiring step;

cutting the flattened tubing perpendicular to a flattened edge at a spacing along the length of the tubing so as to separate from the tubing a flattened annular segment having a width appropriate to the means of attachment, the flattened annular segment being an instance of said attachment device in an incomplete form;

slitting the flattened annular segment longitudinally along a centerline of the flattened annular segment from a flattened edge, said slitting step creating a slit that extends no further than half of the length of the flattened annular segment, said slitting step acting to complete an instance of said attachment device;

repeating said steps of cutting and slitting as appropriate to produce additional instances of said attachment device; and terminating said method of production with a final cutting step to complete the final one of one or more instances of said attachment device.

14. The method of production of claim 13, wherein the steps of cutting and slitting occur simultaneously.

15. The method of production of claim 13, wherein the steps of cutting and slitting occur alternately.

16. The method of production of claim 13, further comprising the step of punching a small diameter hole through two layers of tubing to include two closed ends of the slit opposite an open end at the flattened edge.

17. The method of production of claim 16, wherein the additional step of punching occurs simultaneously with the two steps of cutting and slitting.

18. The method of production of claim 16, wherein the additional step of punching occurs simultaneously with the slitting step, and both steps of punching and slitting occur in alternation with the cutting step.

19. A method of using a pick attachment device to hold a conventional pick for a stringed musical instrument in contact with a finger of an instrumentalist, wherein the pick attachment device comprises a flexible resilient finger-engaging band having a single longitudinal slit through a portion of its circumference, the method of using comprising the steps of:

inserting the pick into the band in such manner that a string-activating portion of the pick protrudes from the interior of the band through and transverse to said longitudinal slit, the pick engaging the band in a region on each side of said longitudinal slit central to the length of said longitudinal slit;

adjusting the pick so that an edge of the pick most nearly opposite the string-activating portion of the pick is engaged by the band in a region interior to the band that is most distant from that which is central to the length of said longitudinal slit; and slipping the finger of the instrumentalist between the pick attachment device and the pick so that a fleshy side of the finger is in contact with a first surface of the pick, and the band engages the nail side of the finger and a second surface of the pick.

* * * * *